United States Patent [19]

Carlson

[11] 4,084,518

[45] Apr. 18, 1978

[54] SWIVEL DRAWER ASSEMBLY

[76] Inventor: David T. Carlson, 923 S. Cardiff, Anaheim, Calif. 92805

[21] Appl. No.: 784,481

[22] Filed: Apr. 4, 1977

[51] Int. Cl.[2] ..... E05G 7/00

[52] U.S. Cl. ..... 109/19; 232/43.3

[58] Field of Search ..... 49/40, 41; 109/19; 232/43.1, 43.3, 43.4, 44

[56] References Cited

U.S. PATENT DOCUMENTS

| | | | |
|---|---|---|---|
| 1,005,535 | 10/1911 | Gillespie | 232/43.3 |
| 1,302,052 | 4/1919 | Jaeger | 232/43.4 X |
| 1,673,882 | 6/1928 | Platt | 109/19 |
| 1,958,321 | 5/1934 | Städtler | 109/19 |
| 3,955,322 | 5/1976 | Call | 49/40 |

*Primary Examiner*—Paul R. Gilliam
*Assistant Examiner*—David H. Corbin
*Attorney, Agent, or Firm*—Warren T. Jessup

[57] ABSTRACT

A swivel drawer assembly is provided which finds general utility in automobile pass-through food dispensing establishments, and which comprises a horizontal tray mounted for swivel movement in a rectangular opening in the wall of the establishment about a first vertical axis at one side of the opening. First and second vertical doors are mounted at right angles to one another on one side of the tray with their junction at the first vertical axis, and third and fourth doors are independently swivelly mounted for rotation about a second vertical axis at the other side of the opening. The third and fourth doors are coupled to the tray through a cam action to be turned about the second vertical axis by the tray, and the assembly is such that when the tray is turned to one limiting position the first and third doors close the opening, and when the tray is turned to its second limiting position the second and fourth doors close the opening.

7 Claims, 6 Drawing Figures

SWIVEL DRAWER ASSEMBLY

BACKGROUND OF THE INVENTION

The swivel door assembly of the present invention represent an improved means for use in an automobile pass-through food dispensing system by which food may be passed from the operator within the establishment to the customer in his automobile, and by which money may be passed from the customer to the operator.

An important objective of the invention is to provide an improved dispensing assembly which serves effectively to seal the interior of the establishment against flys and contamination, and which also provides security against robbery.

The essence of the invention is the provision of a swivel drawer assembly adapted to be mounted in a wall opening having a tray pivotally mounted to one side of the opening for swivel movement through the opening from one side of the wall to the other. First and second vertical doors mounted on the tray extend at right angles to one another along the sides of the tray from the vertical axis mounted for pivoting. Third and fourth vertical drawers mounted at right angles at the opposite side of the opening cooperate with the first and second vertical doors for swivel movement with the tray the first and third doors being closed when the tray is on one side of the opening and the second and fourth coming together to close said opening when the tray is swivelled to the opposite side of the opening.

DETAILED DESCRIPTION OF THE PREFERRED EMBODIMENT

Figure 2:
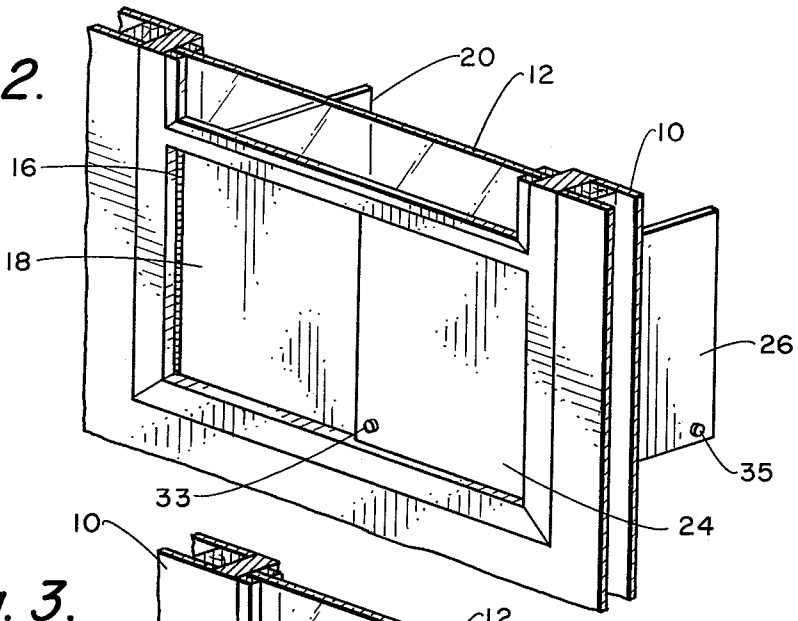
FIGS. 2, 3 and 4 are views of the swivel drawer assembly from the outside of the establishment, and showing the assembly in its various operating positions.

In the drawings, 10 represents the wall of a fast-food establishment, or the like; and 12 represents a double-pane, bullet-proof glass through which the customer in his automobile and the fast-food operator within the establishment can see one another. Any suitable communication system can be provided between the customer and the operator. Beneath the window 12 is a rectangular opening 13 in which is mounted a dispenser assembly which serves as a dispensing means through the wall 12.

The dispenser assembly consists of a horizontal tray 14 pivoted about a first vertical axis positioned at one side of the opening. The tray is provided with a pair of flat rectangular panels or vertical doors 18 and 20 mounted on the edge of the tray at right angles to one another, and which meet at the vertical axis. The doors 18 and 20 and the tray 14 are pivotally supported on the first vertical axis by an appropriate hinge 16.

A second vertical hinge pin 22 is mounted at the opposite side of the rectangular opening 13, with pin 22 extending along a second vertical axis. A second pair of flat rectangular doors 24 and 26 are pivotally mounted on the pin 22 for independent pivotal movement about the second vertical axis. Each of the doors 18, 20, 24 and 26 has a height corresponding to the height of the opening 13, and each of the doors has a width corresponding to one-half or more of the width of the opening. The doors 18, 20 could be considerably wider, if desired, substantially reducing the amount of opening 13 (FIG. 5) exposed at any point in time to an absolute minimum during movement of the tray from inside to outside or vice versa.

Figure 3:
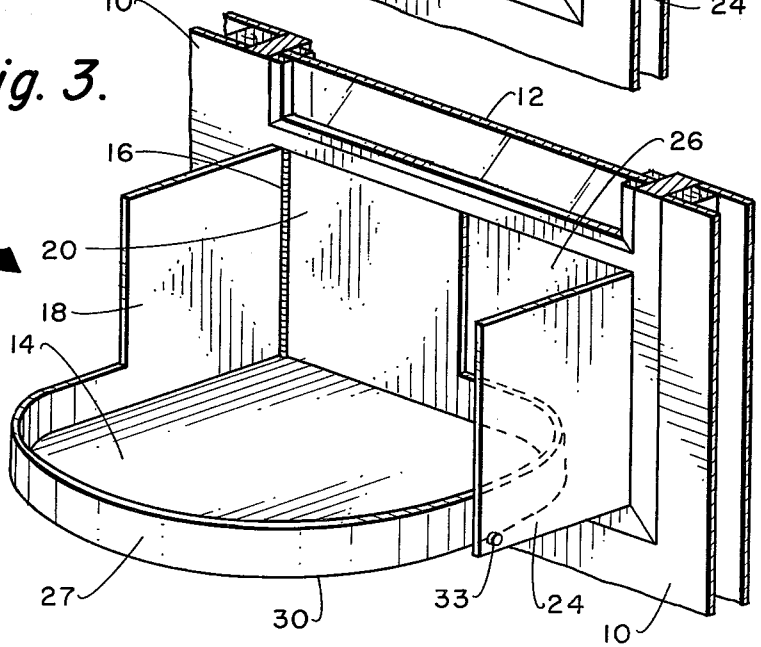
Figure 4:
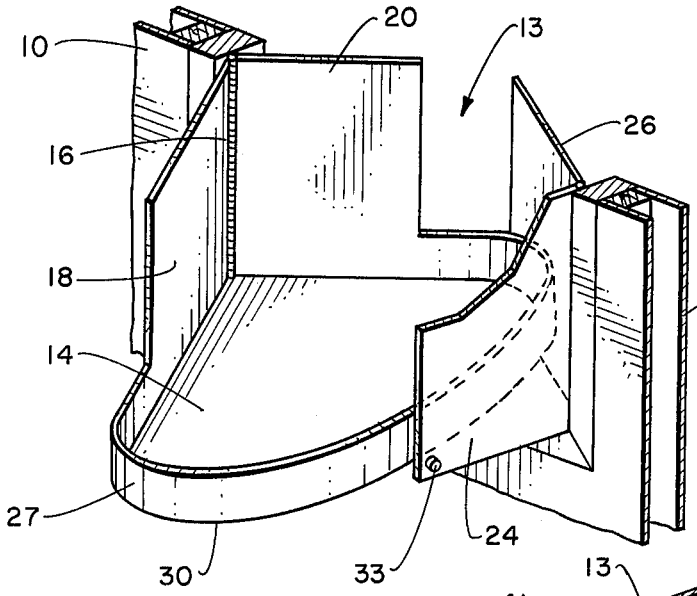
Figure 5:
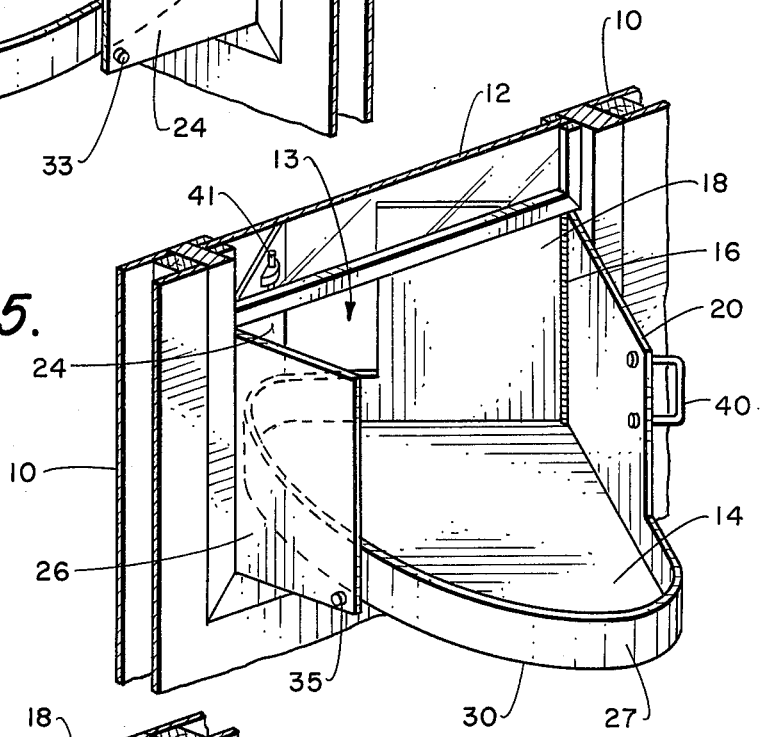
FIGS. 5 and 6 are views of the assembly from inside the establishment, and likewise showing the assembly in different operating positions.
Figure 6:
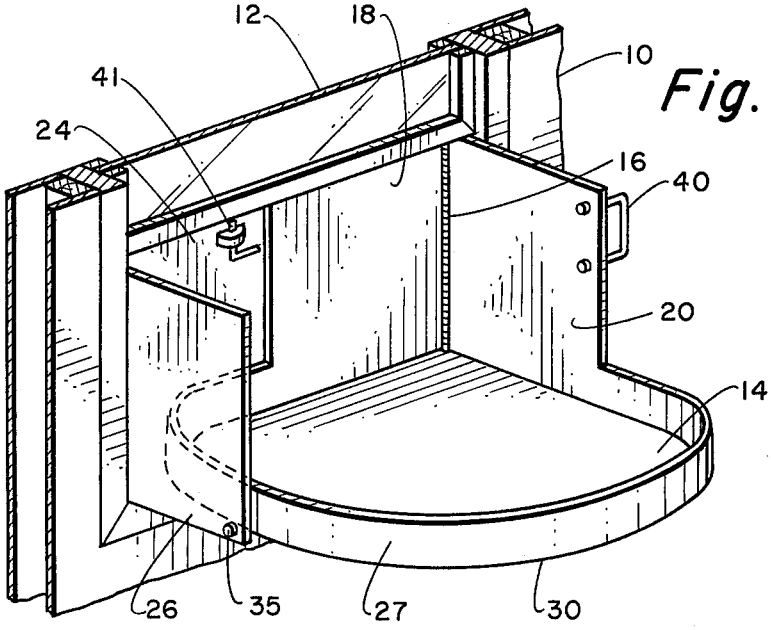

FIGS. 2, 3 and 4 show the assembly as seen by the customer from the outside of the food dispensing establishment. FIGS. 5 and 6 show the assembly as viewed from the inside of the establishment. In FIG. 2 the system is closed, with the tray disposed on the inside of the establishment, and with the opening being closed by the doors 18 and 24. This is the same position of the assembly shown in FIG. 6, as seen from the inside of the establishment.

In FIG. 3 the assembly is in an open position, in which the tray 14 is presented to the customer, either to deliver food to the customer, to receive money from the customer, or to retrieve dishes and the like which have previously been delivered to the customer. In the position of FIG. 3, the opening is closed by the doors 20 and 26, so that the interior of the establishment remains sealed from the exterior. In FIG. 4, the assembly is in an intermediate or transient position, with the tray 14 in the process of being swivelled from one extreme position to the other. FIG. 5 shows the assembly in the same position as FIG. 4, but viewed from inside, rather than from the outside, of the establishment.

Figure 1:
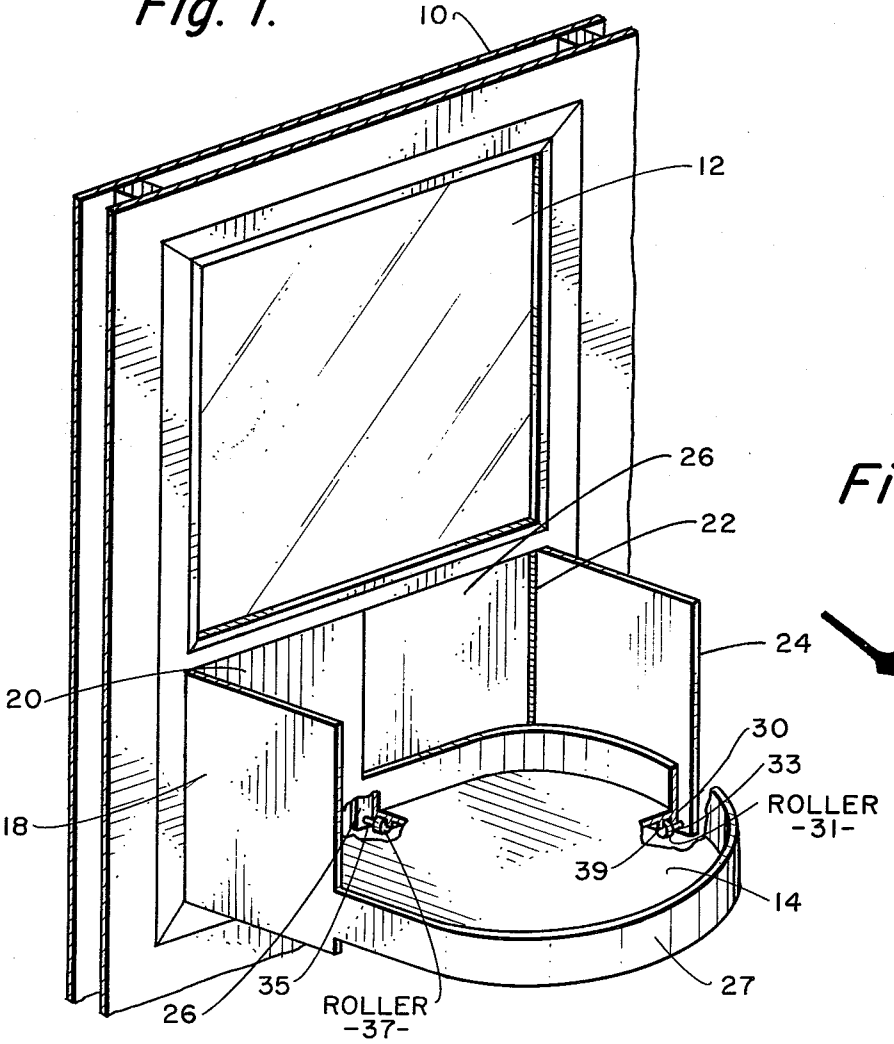
FIG. 1 is a perspective representation of a swivel drawer assembly constructed in accordance with one embodiment of the invention.

The two independently pivoted doors 24 and 26 are controlled by the position of the tray by a cam action, which will now be described in conjunction with FIG. 1. Tray 14 is surrounded by a curved wall 27, the lower edge 30 of which forms a flange. Cam follower means are provided by a first roller 31 mounted on the end of an arm 33 that extends from the bottom edge of door 24, and a second roller 37 mounted on the end of an arm 35 which extends from the lower edge of door 26, both of which ride against the inner surface of the flange.

The arms 33, 35 and the rollers 31, 37 extend underneath the lower edge 30 of wall 27, so that the rollers ride against the inner surface of the flange. A corresponding flange 39 may be provided just inside and matching the contour of the first flange, to form a cam means or channel on the inside bottom edge of the tray 14 in which the rollers 31, 37 may be contained. As the tray 14 is swivelled about the first vertical axis, the sides of the channel drive rollers so as to cause the doors 24 and 26 to pivot independently about the second vertical axis, so as to maintain the various positions shown in FIGS. 2–6.

When the system is in its closed position, as shown in FIG. 6, doors 24 and 26 are substantially at right angles, having been drawn to this position by the channel and roller subassembly described above. The opening 13 is thus completely closed to the outside, as shown in FIGS. 2 and 6. As the tray is swung outwardly to face the customer, the two doors 24 and 26 are cammed almost into alignment, as shown in FIGS. 4 and 5. Then, as the opening operation is completed to bring the assembly to the position shown in FIG. 3, the two doors 24 and 26 again resume a relative position at about right angles to one another, as shown in FIG. 3.

There is a safety feature inherent in the assembly to prevent damage if an automobile driving up to the serving window is too close to the wall 10 of the establishment and strikes the tray 14. The system is preferably designed so that automobile traffic always moves from left to right in FIG. 3, for example, as shown by the arrow. Thus, if an automobile moving in the direction of the arrow in FIG. 3 should strike the tray, it would simply push the tray inwardly through the opening to the position shown in FIGS. 2 and 5 without damaging the assembly in any way.

A handle 40 (FIGS. 5 and 6) is mounted on the inner surface of door 20 to permit the operator conveniently to move the assembly to its various positions shown in FIGS. 2–6. A lock 41 is provided on the inner surface of door 24, so that the assembly can be securely locked in its closed position when the establishment is unattended.

It will be appreciated that although a particular embodiment of the invention has been shown and described, modifications may be made. It is intended in the claims to cover the modifications which come within the spirit and scope of the invention.

What is claimed is:

1. A swivel drawer assembly adapted to be mounted in an opening in a wall, or the like, comprising:

a tray pivotally mounted to one side of said opening for swivel movement through said opening from one side of said wall to the other in a horizontal plane about a first vertical axis disposed at said one side of said opening;

first and second vertical doors mounted on said tray extending at right angles to one another from said first vertical axis for swivel movement with said tray;

third and fourth vertical doors pivotally mounted to the opposite side of said opening for rotation about a common second vertical axis at said opposite side of the opening;

cam means formed on said tray coupling said third and fourth vertical doors for rotation with said tray;

whereby swivel movement of said tray to one side of said wall causes said first and third doors to come together closing said opening and swivel movement of the tray about the first vertical axis to the opposite side of said wall causes the second and fourth doors to come together to close said opening.

2. The swivel drawer assembly defined in claim 1 in which the opening in the wall has a rectangular configuration, and each of the vertical doors has a flat rectangular configuration with a height corresponding to the height of the opening, and with a width corresponding to at least one-half the width of the opening.

3. The swivel drawer assembly defined in claim 1, and which includes handle means mounted on the inner side of the second vertical door to facilitate the movement of the drawer about the first vertical axis.

4. The swivel drawer assembly defined in claim 1, and which includes lock means mounted on the inner surface of the first vertical door to secure the assembly in its first limiting position.

5. The swivel drawer assembly defined in claim 1 including cam follower means attached to the third and fourth doors and engaging said cam means to cause the third and fourth doors to swivel about the second vertical axis as the tray is swivelled about the first vertical axis.

6. The swivel drawer assembly as defined in claim 1, wherein said tray has two substantially straight sides coincident with said first and second doors and a third curved side joining the two straight sides.

7. The swivel drawer assembly according to claim 6, wherein said cam means comprises:

a channel along the underside of the curved side of said tray;

a roller on each of said third and fourth doors engaging said channel whereby the third and fourth doors follow the rotation of said tray.

* * * * *